US010267548B2

(12) United States Patent
Esformes et al.

(10) Patent No.: US 10,267,548 B2
(45) Date of Patent: Apr. 23, 2019

(54) OIL MANAGEMENT FOR HEATING VENTILATION AND AIR CONDITIONING SYSTEM

(71) Applicant: Carrier Corporation, Farmington, CT (US)

(72) Inventors: Jack Leon Esformes, Jamesville, NY (US); Marcel Christians, Skaneateles, NY (US); Satyam Bendapudi, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 251 days.

(21) Appl. No.: 14/768,757

(22) PCT Filed: Feb. 14, 2014

(86) PCT No.: PCT/US2014/016457
§ 371 (c)(1),
(2) Date: Aug. 18, 2015

(87) PCT Pub. No.: WO2014/130356
PCT Pub. Date: Aug. 28, 2014

(65) Prior Publication Data

US 2016/0003511 A1 Jan. 7, 2016

Related U.S. Application Data

(60) Provisional application No. 61/767,039, filed on Feb. 20, 2013.

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01); *F25B 2341/0016* (2013.01)

(58) Field of Classification Search
CPC ..... F25B 43/02; F25B 31/004; F25B 2341/0016; F25B 43/00; F25B 31/002;
(Continued)

(56) References Cited

U.S. PATENT DOCUMENTS 3,004,396 A 10/1961 Endress et al.
3,336,762 A 8/1967 Patterson
(Continued)

FOREIGN PATENT DOCUMENTS

CN 1208842 A1 2/1999
CN 1692262 A 2/2005
(Continued)

OTHER PUBLICATIONS

Notification of Transmittal of the International Search Report and the Written Opinion of the International Searching Authority; PCT/US2014/016457; EP Patent Office; dated May 14, 2014; ISR 5 pages; WO 7 pages.
(Continued)

*Primary Examiner* — Emmanuel Duke
(74) *Attorney, Agent, or Firm* — Cantor Colburn LLP

(57) ABSTRACT

A method of lubricant management in a heating ventilation and air conditioning (HVAC) system includes flowing a volume of a compressor lubricant and refrigerant mixture from an evaporator into a lubricant still and stopping the flow of the compressor lubricant and refrigerant mixture into the lubricant still when the mixture fills the lubricant still to a selected level. Compressor lubricant is distilled from the mixture via a thermal energy exchange, and the distillation is stopped when a concentration of compressor lubricant in the lubricant still exceeds a predetermined concentration level. The distillate is urged from the lubricant still.

18 Claims, 2 Drawing Sheets

(58) Field of Classification Search
CPC ..... F25B 25/005; F25B 1/047; F25B 40/06; F24F 12/003
See application file for complete search history.

(56) References Cited

U.S. PATENT DOCUMENTS

| | | | | |
|---|---|---|---|---|
| 3,848,425 | A | 11/1974 | Watkins | |
| 5,343,711 | A * | 9/1994 | Kornhauser | F25B 1/06 417/198 |
| 5,454,228 | A | 10/1995 | Yang et al. | |
| 5,461,883 | A | 10/1995 | Terasaki | |
| 6,082,982 | A | 7/2000 | Rosser, Jr. et al. | |
| 6,176,092 | B1 * | 1/2001 | Butterworth | F04D 29/023 62/193 |
| 6,182,467 | B1 | 2/2001 | Zhong et al. | |
| 6,233,967 | B1 | 5/2001 | Seewald et al. | |
| 6,374,629 | B1 | 4/2002 | Oberle et al. | |
| 6,550,258 | B1 | 4/2003 | Shoulders | |
| 6,672,102 | B1 * | 1/2004 | Huenniger | F25B 1/047 62/472 |
| 6,739,147 | B1 * | 5/2004 | Sishtla | F04C 29/026 62/192 |
| 6,904,759 | B2 * | 6/2005 | Shoulders | B01D 1/0017 62/472 |
| 7,124,594 | B2 | 10/2006 | McRell | |
| 7,827,807 | B2 | 11/2010 | Narayanamurthy et al. | |
| 8,109,107 | B2 | 2/2012 | Narayanamurthy et al. | |
| 8,234,876 | B2 | 8/2012 | Parsonnet et al. | |
| 2007/0256432 | A1 | 11/2007 | Zugibe et al. | |
| 2008/0210601 | A1 * | 9/2008 | Shoulders | F25B 31/004 208/184 |

FOREIGN PATENT DOCUMENTS

| | | | |
|---|---|---|---|
| DE | 586076 | C * | 10/1933 |
| DE | 586076 | C | 10/1933 |
| EP | 0016509 | A2 | 10/1980 |
| FR | 759283 | A * | 1/1934 |
| WO | 0104551 | A2 | 1/2001 |
| WO | 2007008193 | A2 | 1/2007 |

OTHER PUBLICATIONS

State Intellectual Property Office People's Republic of China Search Report; Application No. 201480009712.8; 3 pages.

* cited by examiner

OIL MANAGEMENT FOR HEATING VENTILATION AND AIR CONDITIONING SYSTEM

BACKGROUND

The subject matter disclosed herein relates to heating, ventilation and air conditioning (HVAC) systems. More specifically, the subject matter disclosed herein relates to compressor oil management for HVAC systems.

HVAC systems, such as chillers, often use a flooded or falling film evaporator to facilitate a thermal energy exchange between a refrigerant in the evaporator and a medium flowing in a number of evaporator tubes positioned in the evaporator. The compressor in such systems requires lubrication, typically via oil, to remain operational. As such, a portion of the oil used to lubricate the compressor intermingles with the flow of refrigerant through the compressor and finds its way into the refrigerant flow to the evaporator. When the system is at full load, the refrigerant in the evaporator is continuously contaminated with between about 1% and 5% oil. At partial load, vapor velocity in the evaporator is not sufficient to carry oil from the evaporator to the suction line, so oil accumulates in the evaporator. It is desired to remove the oil from the evaporator for at least two reasons. First, the oil is needed to lubricate the compressor, so it is desired to return the oil to the compressor to replenish a supply thereat. Without doing so, the oil will eventually be depleted from the compressor oil sump. Second, the oil in the evaporator degrades the performance of the system, in particular, the evaporator.

Chillers and other HVAC systems often include an oil management system in a effort to ensure a continuous supply of oil to the compressor. Such an oil management system typically includes an ejector, essentially a pump, which is run continuously to remove refrigerant-rich oil from the evaporator. The ejector uses compressor discharge gas as its working fluid to draw the oil-rich refrigerant from the evaporator and transport it, together with the discharge gas, back to the compressor. This operation, in a typical system, results in about 1% to 2% additional energy consumption by the HVAC system. Further, the typical oil management system leaves the evaporator refrigerant charge continuously contaminated with about 1.5% to 3% oil. This continual contamination reduces overall heat transfer performance of the evaporator by about 3% to 10%. Additionally, in HVAC systems utilizing low pressure refrigerants, the oil contamination causes a reduction in refrigerant vapor pressure resulting in up to an additional about 1% in HVAC system energy consumption.

BRIEF SUMMARY

In one embodiment, a heating, ventilation and air conditioning (HVAC) system includes a compressor having a flow of compressor lubricant therein, the compressor compressing a flow of vapor refrigerant therethrough and an evaporator operably connected to the compressor including a plurality of evaporator tubes through which a volume of thermal energy transfer medium is flowed for a thermal energy exchange with a liquid refrigerant in the evaporator. The HVAC system further includes a lubricant management system including a lubricant still receptive of a flow of compressor lubricant and refrigerant mixture from the evaporator. An inlet flow control device is utilized to stop the flow of the mixture into the lubricant still when a mixture level in the still reaches a selected level, and an outlet flow control device is utilized to urge distillate from the lubricant still when a concentration of lubricant in the distillate reaches a selected concentration level.

In another embodiment, a method of lubricant management in a heating ventilation and air conditioning (HVAC) system includes flowing a volume of a compressor lubricant and refrigerant mixture from an evaporator into a lubricant still and stopping the flow of the compressor lubricant and refrigerant mixture into the lubricant still when the mixture fills the lubricant still to a selected level. Compressor lubricant is distilled from the mixture via a thermal energy exchange, and the distillation is stopped when a concentration of compressor lubricant in the lubricant still exceeds a predetermined concentration level. The distillate is urged from the lubricant still.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
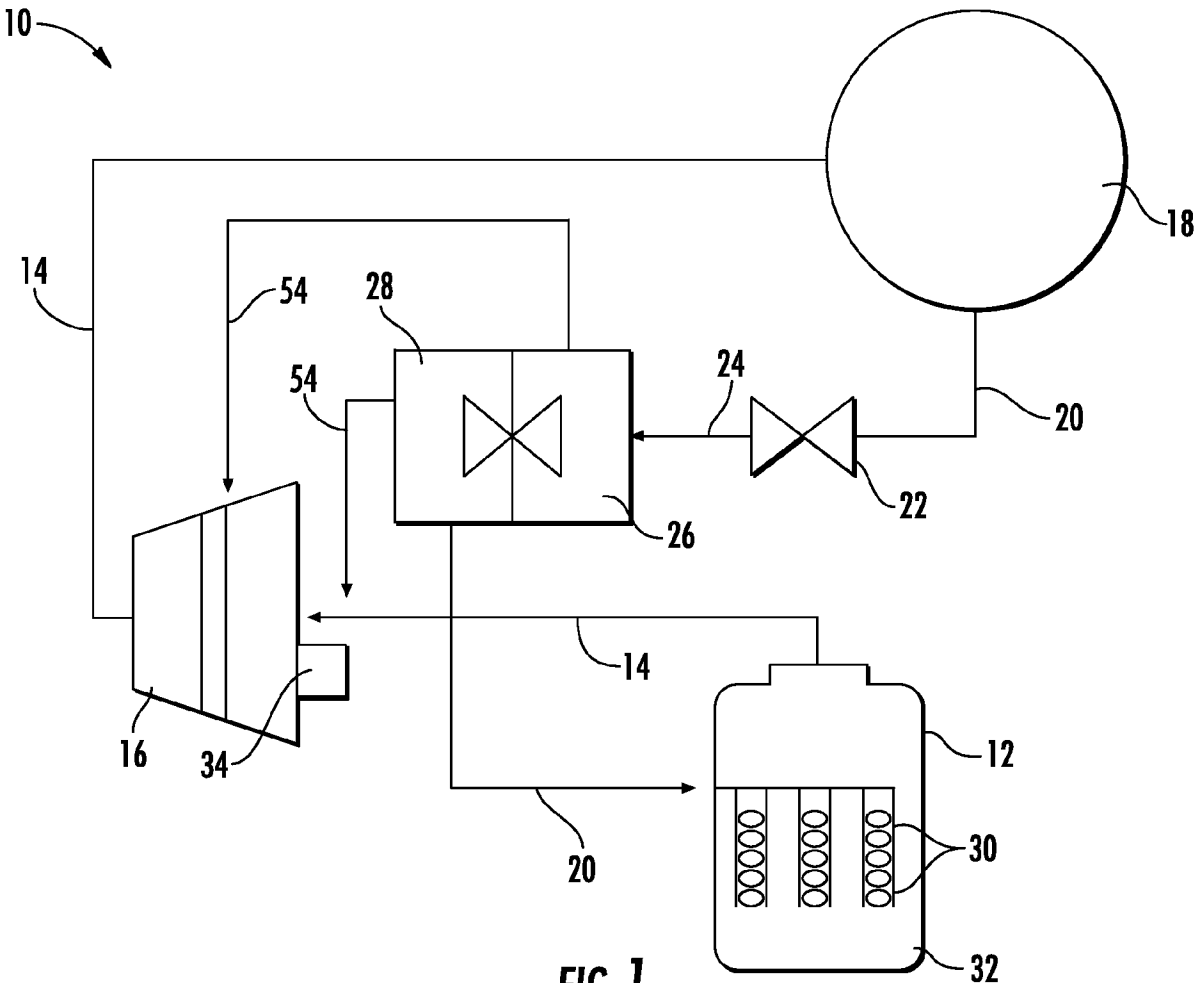
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16, such as a centrifugal or screw compressor, and then to a condenser 18 that outputs a flow of liquid refrigerant 20 to an expansion valve 22. The expansion valve 22 outputs a vapor and liquid refrigerant mixture 24 to, in some embodiments, an economizer 26 and then to a separator 28, in which portions of vapor refrigerant are separated from liquid refrigerant and returned to the compressor 16. The liquid refrigerant output by the separator 28 is routed to the evaporator 12. It is to be appreciated that, in other embodiments, the vapor and liquid refrigerant mixture 24 may be routed directly to the evaporator 12 from the expansion valve 22.

A thermal energy exchange occurs between a flow of heat transfer medium flowing through a plurality of evaporator tubes 30 into and out of the evaporator 12 and the liquid refrigerant 20 flowing over the evaporator tubes 30 and into a refrigerant pool 32, such as in a falling film evaporator, shown. In other embodiments, the evaporator 12 is a flooded evaporator where the evaporator tubes 30 are submerged in the refrigerant pool 32. As the liquid refrigerant 20 is boiled off in the evaporator 12, the vapor refrigerant 14 is directed to the compressor 16.

The compressor 16 requires a flow of lubricant, such as oil or other liquid lubricant, therethrough to prevent overheating and damage to the compressor 16. Oil is provided from an oil sump 34 to the compressor 16. As the compressor 16 operates, a portion of the oil becomes mixed with or entrained in the flow of refrigerant through the chiller 10. It is desirable to prevent depletion of the oil supply in the oil sump 34 and prevent buildup of oil in the evaporator 12, which negatively affects evaporator 12 and chiller 10 performance.

Figure 2:
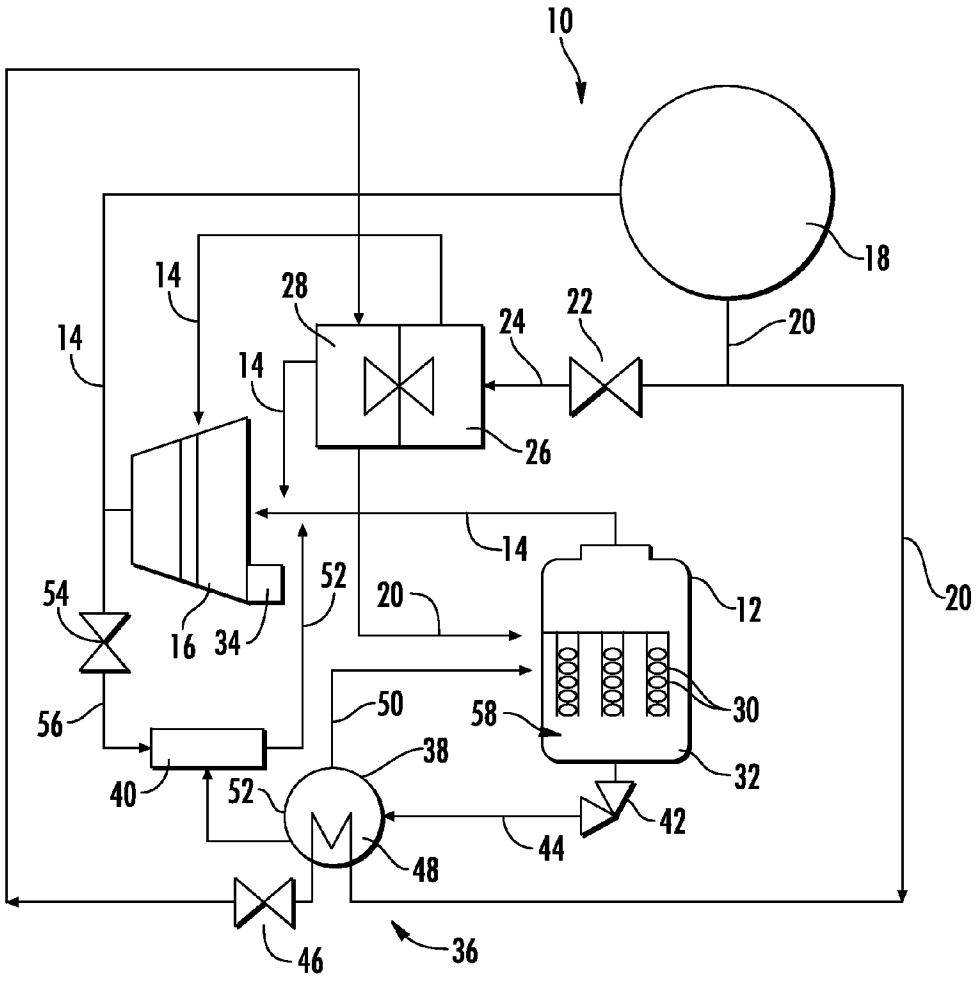
FIG. 2 is a schematic view of an embodiment of an oil management system for an HVAC system.

Referring now to FIG. 2, and embodiment of an oil management system 36 is shown with the chiller 10. The oil management system 36 includes an oil still 38, with an ejector 40 operated intermittently to reduce oil content in the evaporator 12, while reducing energy consumption of the chiller 10, compared to prior art chillers having a continuously operating ejector. To begin a cycle of the oil management system 36, evaporator valve 42 is opened allowing a flow of refrigerant and oil mixture 44 to flow into and fill the oil still 38, typically via gravity. Evaporator valve 42 is then closed. Oil still valve 46 is opened, forcing warm liquid refrigerant 20 to flow from the condenser 18 to a still heat exchanger 48, for example a coil. It should be appreciated that hot gas refrigerant 14 from the compressor 16 may be used in place of warm liquid refrigerant 20. As the liquid refrigerant 20 flows through the still heat exchanger 48, the refrigerant and oil mixture 44 boils. The liquid refrigerant 20, after flowing through the still heat exchanger 48 is subcooled by the process and flowed into the separator 28, or alternatively the evaporator 12, through the oil still valve 46. The boiling process in the oil still 38 results in vapor refrigerant, which is vented to the evaporator 12 via still vent 50. After venting the vapor refrigerant to the evaporator, a high-concentration oil mixture 52, for example, over 50% oil, remains in the oil still 38. When a preset time interval is reached or temperature and/or pressure, or level in the still indicates a high oil concentration, the oil still valve 46 is closed to stop the flow from the condenser 18 to the oil still 38. The opening and/or closing of valves 46 and 42 may be controlled by, for example, a timer or by a temperature and/or pressure sensor in the oil still 38. The oil mixture 52 is returned to the compressor 16 by opening an ejector valve 54 to direct compressor discharge gas 56 into the ejector 40, thereby drawing the oil mixture 52 from the oil still 38 and urging the oil mixture 52 to the compressor 16. Once the oil mixture 52 is discharged to the compressor 16, operation of the ejector 40 is stopped by closing the ejector valve 54. As above, opening and closing of the ejector valve 54 may be done via a timed operation, by sensing an oil level in the oil still 38, or the like. It should be understood that an oil pump may be used in lieu of an ejector provided that the cost impact to the system is not unfavorable.

Further, in some embodiments, the frequency of operation of the oil management system 36 may be determined by a need to control an oil concentration in the evaporator 12 around a predetermined set point, for example, about 1% concentration of oil in the evaporator 12. In such embodiments, a sensor 58 located in the evaporator 12, for example, a temperature and pressure sensor, is utilized to determine the oil concentration in the evaporator 12. It is to be appreciated that other measurements, such as a refractive index measurement, may be used to determine the oil concentration in the evaporator 12. If the oil concentration exceeds the set point, the operation of the oil management system 36 is triggered by the sensor 58 or other means. Similarly, when the oil concentration no longer exceeds the set point, operation of the oil management system 36 is stopped.

Intermittent operation of the ejector 40, as described above, increases chiller 10 performance over prior art systems with continuously operation ejectors, as discharge gas 56 is only routed to the ejector 40 when needed, and can thus flow to the condenser 18 when the ejector valve 54 is closed. Further, the reduction in oil concentration at the evaporator 12 allows for increased evaporator efficiency, which can translate into reduced material costs for the evaporator 12 since comparable chiller 10 performance can be achieved with a smaller evaporator 12. In some embodiments, chiller 10 energy consumption is reduced by about 0.5 to 1.5% compared to prior art systems with an additional 1% benefit for low pressure systems, those using refrigerant having a liquid phase saturation pressure below about 45 psi (310.3 kPa) at 104° F. (40° C.). An example of low pressure refrigerant is R245fa. Further, in some embodiments, evaporator 12 oil concentrations can be maintained under about 1%, translating into a material savings for evaporator 12 of between about 1% and about 4%.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising: a compressor having a flow of compressor lubricant therein, the compressor compressing a flow of vapor refrigerant therethrough; an evaporator operably connected to the compressor including a plurality of evaporator tubes through which a volume of thermal energy transfer medium is flowed for a thermal energy exchange with a liquid refrigerant in the evaporator; and a lubricant management system including: a lubricant still receptive of a flow of compressor lubricant and refrigerant mixture from the evaporator; an inlet flow control device to stop the flow of the mixture into the lubricant still when a mixture level in the still reaches a selected level; and an ejector utilizing discharge gas from the compressor as a working fluid to intermittently urge compressor lubricant from the lubricant still when a concentration of lubricant in the distillate reaches a selected concentration level; wherein operation of the ejector is regulated by an ejector valve controlling a flow of the working fluid to the ejector.

2. The HVAC system of claim 1, wherein the lubricant still further includes a lubricant still heat exchanger having a flow of refrigerant therethrough to boil the compressor lubricant and refrigerant mixture.

3. The HVAC system of claim 2, wherein the flow of refrigerant is diverted from a condenser of the HVAC system.

4. The HVAC system of claim 2, wherein the flow of refrigerant through the lubricant still heat exchanger is regulated by a lubricant still valve.

5. The HVAC system of claim 1, wherein the selected concentration of lubricant in the lubricant still is indicated by one of a time interval, vapor pressure, temperature, or level.

6. The HVAC system of claim 1, wherein the lubricant still includes a still vent to vent vapor refrigerant from the lubricant still to the evaporator.

7. A method of lubricant management in a heating ventilation and air conditioning (HVAC) system comprising: flowing a volume of a compressor lubricant and refrigerant mixture from an evaporator into a lubricant still; stopping the flow of the compressor lubricant and refrigerant mixture into the lubricant still when the mixture fills the lubricant still to a selected level; distilling compressor lubricant from the mixture via a thermal energy exchange; stopping the distillation when a concentration of compressor lubricant in the lubricant still exceeds a predetermined concentration level; and intermittently urging the compressor lubricant from the lubricant still via an ejector utilizing discharge gas from a compressor as a working fluid; wherein operation of the ejector is regulated by an ejector valve controlling a flow of the working fluid to the ejector.

8. The method of claim 7, further comprising flowing another volume of compressor lubricant and refrigerant mixture from an evaporator into the lubricant still after urging the compressor lubricant from the lubricant still.

9. The method of claim 7, further comprising:

urging a flow of heat transfer medium through a heat exchanger at the lubricant still; and distilling compressor lubricant from the mixture via a thermal energy exchange with the heat transfer medium.

10. The method of claim 9, wherein the heat transfer medium is a flow of refrigerant diverted from a condenser or a compressor of the HVAC system.

11. The method of claim 10, further comprising flowing the flow of refrigerant from the heat exchanger of the lubricant still to a separator of the HVAC system.

12. The method of claim 7, further comprising venting vapor refrigerant from the lubricant still.

13. The method of claim 12, further comprising venting the vapor refrigerant to the evaporator.

14. The method of claim 7, further comprising urging the distillate from the lubricant still to the compressor of the HVAC system.

15. The method of claim 7, wherein the concentration level of lubricant in the lubricant still is indicated by one of a vapor pressure, temperature, time interval or level.

16. The method of claim 7, further comprising determining a level of compressor lubricant concentration in the evaporator.

17. The method of claim 16, further comprising urging the mixture to the lubricant still when the compressor lubricant concentration in the evaporator exceeds a set point concentration.

18. The method of claim 17, further comprising stopping flow of the mixture to the lubricant still when the compressor lubricant concentration in the evaporator is below the set point concentration.

* * * * *